United States Patent [19]

Weight

[11] Patent Number: 4,509,153

[45] Date of Patent: Apr. 2, 1985

[54] RESOLUTION TRANSDUCERS, SYSTEMS AND METHODS FOR THE TRANSMISSION AND/OR RECEPTION OF WAVES PROPAGATED BY VIBRATION

[75] Inventor: John P. Weight, Crowborough, England

[73] Assignee: National Research Development Corporation, London, England

[21] Appl. No.: 349,524

[22] Filed: Feb. 17, 1982

[30] Foreign Application Priority Data

Feb. 19, 1981 [GB] United Kingdom ..... 8105195

[51] Int. Cl.[3] ..... B06B 1/02

[52] U.S. Cl. ..... 367/140; 310/357; 310/365; 367/103

[58] Field of Search ..... 367/103, 105, 905, 87, 367/99, 140; 310/357, 358, 365

[56] References Cited

U.S. PATENT DOCUMENTS

| | | | |
|---|---|---|---|
| 2,928,068 | 3/1960 | Samsel et al. | 367/905 X |
| 2,956,184 | 10/1960 | Pollack | 367/905 X |
| 3,918,024 | 11/1975 | Macovski | 367/103 X |
| 3,974,475 | 8/1976 | Burckhardt et al. | 367/103 X |
| 4,052,693 | 10/1977 | Gilmour | 367/103 |
| 4,069,467 | 1/1978 | Burckhardt et al. | 367/103 X |
| 4,241,611 | 12/1980 | Specht et al. | 367/103 X |

*Primary Examiner*—Richard A. Farley

*Attorney, Agent, or Firm*—Cushman, Darby & Cushman

[57] ABSTRACT

Problems of resolution and focussing arise in the near field in systems employing radiation, including ultrasonic systems. These problems can be alleviated by suppressing the plane waves in the combination of plane waves and edge waves usually employed. Several ultrasonic transducers with this property are described and in one a piezoelectric disc with surface electrodes is non-linearly polarized to transmit edge waves without plane waves.

12 Claims, 30 Drawing Figures

Figure 1:
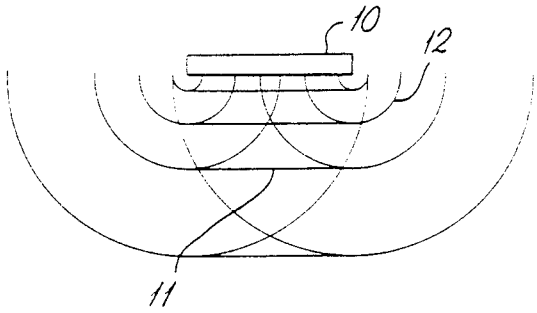

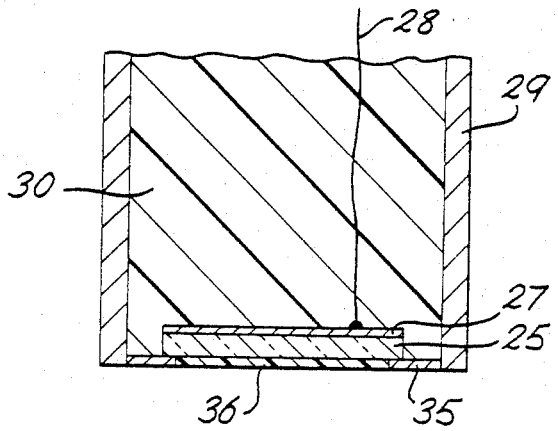
Fig. 11
Fig. 14b
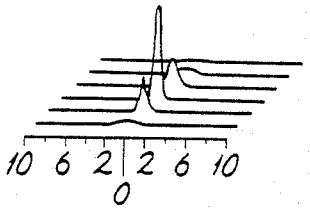
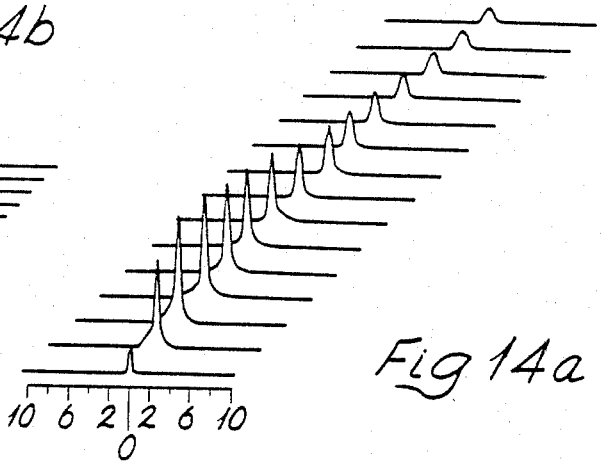
Fig 14a

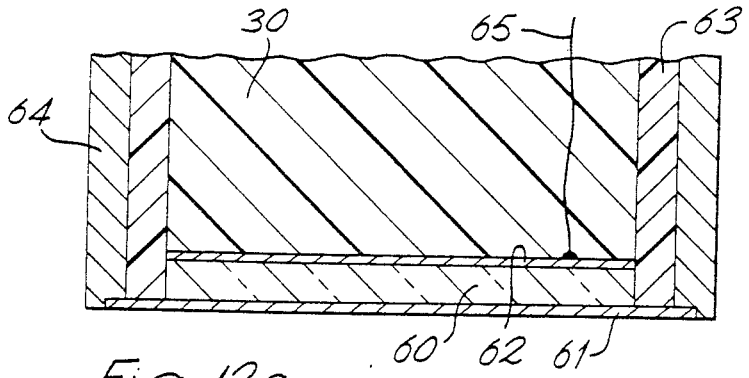
Fig. 12a
Fig. 12b
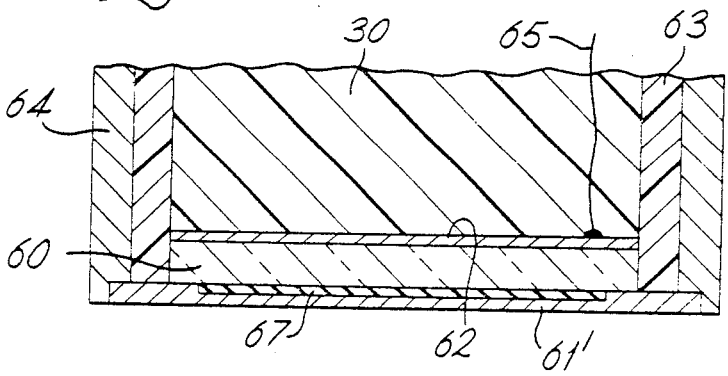
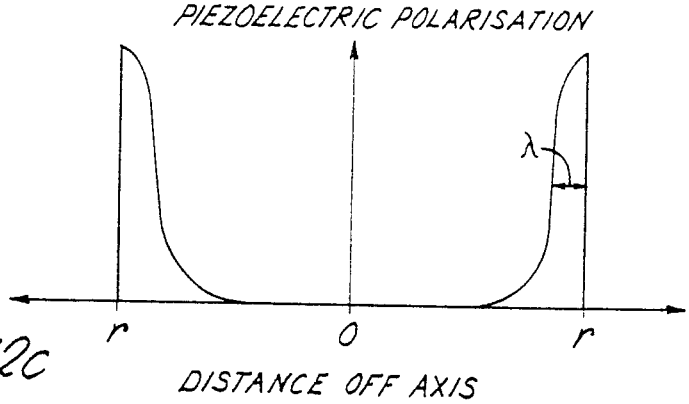
Fig. 12c

RESOLUTION TRANSDUCERS, SYSTEMS AND METHODS FOR THE TRANSMISSION AND/OR RECEPTION OF WAVES PROPAGATED BY VIBRATION

The present invention relates to improvements in the resolution of transducers for the transmission and/or reception of waves propagated by vibration of the propagating medium, and also to systems and methods employing waves propagated in this way. The invention is particularly useful in sonar and ultrasonics.

Ultrasonic pulse-echo techniques are used in sonar, nondestructive testing (NDT) and in medical diagnosis. In each of these applications a transducer emits short pulses, usually of ultrasound, which produce echoes from some target, enabling the target to be located and characterised. Typically, the fractional bandwidth of the pulse spectrum is about $\frac{1}{2}$. Thus, for example, with a centre frequency of 6 MHz and a fractional bandwidth of $\frac{1}{2}$, the frequency range of the pulse spectrum is 4.5 to 7.5 MHz. Echoes may be received by a second (receiving) transducer or by the emitting transducer. In the latter case the target range must be large enough to ensure that its echo is not received in the 'dead time' before the electrical and mechanical effects of emission have died away.

The resolution obtained with such a technique depends on the transducer. Range resolution is determined by the effective pulse length, which for a practical transducer cannot easily be less than one cycle of a sinusoidal wave. Lateral resolution is governed by the width of the emitted beam, which for conventional plane transducers is about the same as the width of the transducer. In practice, pulses of several cycles are used in sonar and medical diagnosis, giving the typical resolutions shown in Table I.

TABLE I

| System type | Centre frequency of pulse | Range resolution | Lateral resolution |
|---|---|---|---|
| Sonar | 1 kHz–100 kHz | 10 m–0.1 m | 100 m–1 m |
| Medical diagnosis | 1–5 MHz | 5 mm–1 mm | 20 mm–10 mm |
| NDT | 1–20 MHz | 5 mm–0.3 mm | 20 mm–5 mm |

In both medical diagnosis and NDT the higher frequencies shown in the table can only be used in specialised cases where the material under investigation will transmit such frequencies without undue attenuation.

Better lateral resolution can be obtained by using shaped focussing transducers. However, the improvement is obtained only in a limited depth range near the focus, which occurs at different ranges with different materials.

Recently published work, such as "Observations of the Propagation of Very Short Ultrasonic Pulses and their Reflection by Small Targets" by J. P. Weight and A. J. Hayman, The Journal of the Accoustical Society of America, Vol. 63, No. 2, February 1978, pages 396 to 404, has shown that the pulses propagating from an ultrasonic transducer consist of a plane wave propagating in the geometrical beam region straight ahead of the transducer, plus a diffracted edge wave which propagates in all directions from the periphery of the transducer. This plane and edge wave structure severely affects the on-axis near-field range resolution when the target is small. (In the case of a transducer emitting continuous waves, the near field extends from the transducer to $r^2/\lambda$, where r is the radius of the transducer aperture—that is the disc radius for a piezoelectric disc, and $\lambda$ is wavelength.) In effect, in the transmit-receive mode of operation, the pulse length is increased to twice the time difference between energy reaching the target from the centre and from the edge of the transducer.

According to a first aspect of the present invention there is provided a method of transmitting or receiving waves propagated by vibration of the propagating medium by transmitting or receiving edge waves, as hereinafter defined, substantially without plane waves.

According to a second aspect of the present invention there is provided a method of transmitting and receiving waves propagated by vibration of the propagating medium by transmitting and receiving edge waves, as hereinafter defined, without both transmitting and receiving substantial plane waves.

According to a third aspect of the invention there is provided a transducer for transmitting (or receiving) waves propagated by the vibration of the propagating medium comprising means so constructed or arranged that in operation edge waves as hereinafter defined can be transmitted (or received) without the substantial transmission of (or without substantial response to) plane waves.

In methods and transducers according to the invention the propagation of rings of edge waves, particularly circular rings is usually preferable.

In the present specification and claims the term "edge waves" means that form of spreading waves which if propagated from a circular source have a theortically constant peak pressure on the axis of the source at least in the near field. The above mentioned paper gives more information relating to the nature of edge waves.

An advantage of the present invention is that, particularly in ultrasonics and sonar, when a ring shape of edge waves is transmitted and/or received, improvements in lateral resolution of an order of magnitude can be achieved as can a useful improvement in near field range resolution. The resolution can be as good as the best that can be obtained using a focussing transducer, but unlike a focussing transducer resolution is maintained over a comparatively large distance. At short ranges the range resolution is better than with a normal transducer, and similar sensitivities are obtained for targets of different sizes. This can be an advantage in testing and imaging, where large specular reflections obtained from known boundaries when plane waves propagate can swamp the signals from targets or structures of interest.

The ring shape of edge waves emitted or received at a transducer provides a "built in" delay equal to twice the transit time across the transducer radius. This markedly reduces the "dead zone" in front of the transducer in which there is no response to targets.

As is explained below the present invention gains its advantages by removing (or not generating or responding to) the plane wave component of signals transmitted and/or received. The result is that the number of output pulses from received reflections is reduced, since those due to the plane wave are absent. Thus in one system a single transmit pulse results in a single output pulse in reception rather than three such pulses. Furthermore the receive pulse is a maximum only for targets on the axis of the transducer and its amplitude rapidly drops off with lateral displacement from this axis.

For ideal plane wave suppression the pressure of waves transmitted from a surface should follow a Gaussian distribution with the maximum of the distribution at that edge from which the wave theoretically originates. This ideal can be approached by non-linear excitation of a piezoelectric disc element or a non-linearly polarized piezoelectric disc element where the non-linearity follows a Gaussian distribution as nearly as possible. The required distribution can also be obtained by shaping the relief of a transmitting surface in conjunction with non-linear excitation or polarization. A combination of these techniques can be used in transducers for transmission or reception or both.

As is known the problem of side lobe generator can be overcome by making transducers (in this case transucers according to the invention) suitable for the transmission or reception of wide band pulses, that is pulses consisting of a single cycle.

Simple transducers according to the invention may include transducers comprising a disc of piezoelectric material with electrodes on the major surfaces of the disc. All but a peripheral region of the disc may be masked by an attenuating plate which does not transmit significantly in the frequency range of operation of the transducer and hence largely prevents plane waves from being transmitted.

In another form of simple transducer according to the invention a piezoelectric disc has a back electrode covering the whole of one major surface of the disc and a front electrode in the form of an annulus in contact with the other major surface of the disc at the outer periphery of the disc. As a result of fringing electric fields set up when the electrodes are excited, the disc has a very approximately Gaussian excitation.

Separate transmission and reception transducers may be used and for this purpose any practical combination of the above mentioned transducers may be used. In addition one of the transducers may be conventional transducer in which plane waves are not suppressed.

Figure 8:
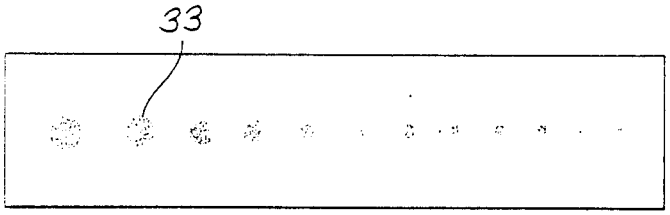
Figure 9:
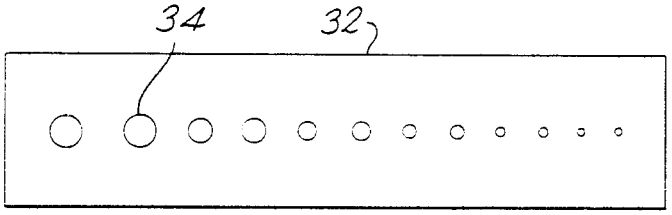
Figure 10:
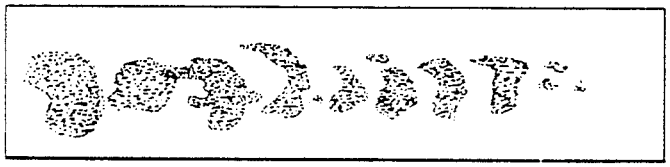
Figure 2A:
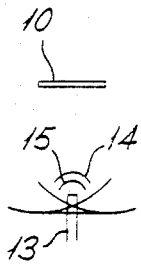
Figure 2B:
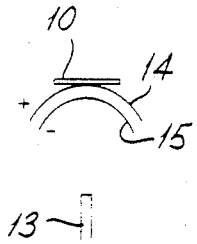
Figure 2C:
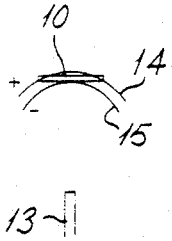
Figure 2D:
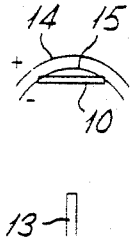
Figure 4A:
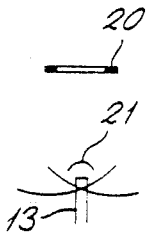
Figure 4B:
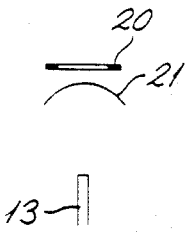
Figure 4C:
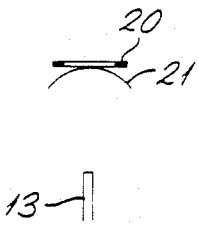
Figure 4D:
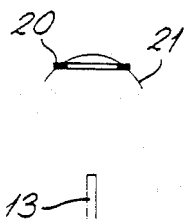
Figure 5A:
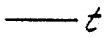
Figure 5B:
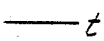
Figure 5C:
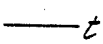
Figure 5D:
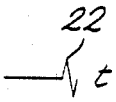
Figure 6:
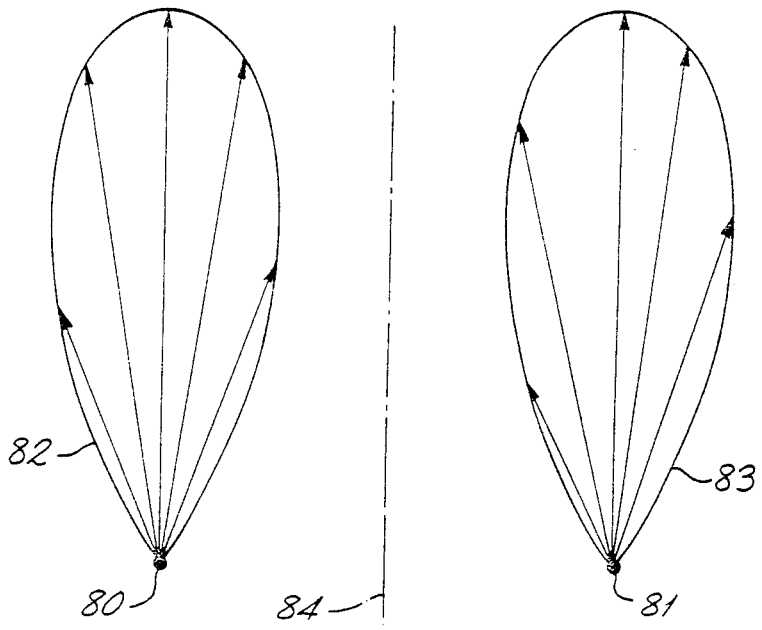
Figure 7:
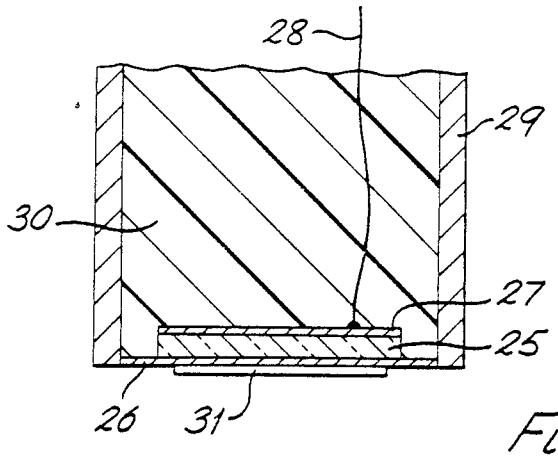
Figure 13A:
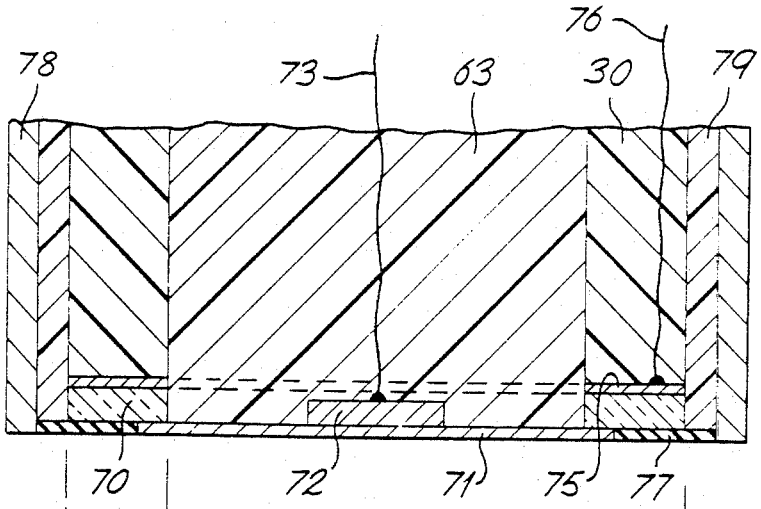
Figure 13B:
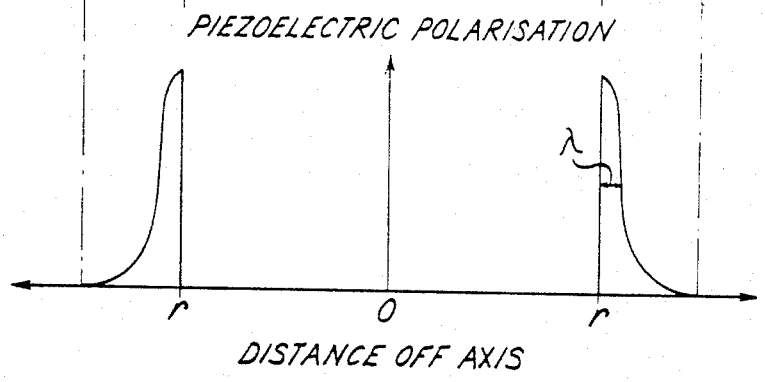

Certain embodiments of the invention will now be described, by way of example, with reference to the accompanying drawings, (not necessarily to scale), in which:

FIG. 1 is a diagram of waves transmitted from a prior art ultrasonic transducer, as would be observed using a stroboscopic Schlieren system, FIGS. 2*a* to 2*d* are Schlieren diagrams representing different instants of reflection of plane and edge waves from an object, on axis, FIGS. 3*a* to 3*d* show the voltage outputs obtained from an ultrasonic system at the instants shown in FIGS. 2*a* and 2*d*, respectively, FIGS. 4*a* to 4*d* are Schlieren diagrams at different instants when an edge wave only is reflected from an object, on axis, FIGS. 5*a* to 5*d* show the voltage output of an ultrasonic system corresponding to the instants of FIGS. 4*a* to 4*d*, respectively, FIG. 6 shows polar diagrams for diametrically opposite points on a circular edge wave source, FIG. 7 shows a transducer which may be employed in a system according to the invention and which uses a piezoelectric disc as the transducer element, FIG. 8 is a diagram representing a C scan image using a transducer according to the invention, FIG. 9 shows the target used in obtaining the image of FIG. 10, FIG. 10 is a C scan image obtained using a prior art transducer, FIG. 11 shows a transducer according to the invention which uses a non-linearly excited piezoelectric disc, FIGS. 12*a* and 12*b* show transducers according to the invention in which non-linearly polarized piezoelectric elements are used, FIG. 12*c* shows the form of polarization of the elements of FIGS. 12*a* and 12*b*, FIG. 13*a* shows a transducer according to the invention in which a non-linearly polarized piezoelectric annulus is used, FIG. 13*b* shows the form of polarization of the annulus of FIG. 13*a*, and FIGS. 14*a* and 14*b* show wide band beam profiles of a transducer according to the invention and a prior art transducer, respectively.

Most theoretical studies of ultrasonics are based on the Huygens principle that a plane wave is made up of a large number of spherical wavelets and for this reason a disc of piezoelectric material used as an ultrasonic transmitter has often been considered as generating a plane wave.

However, as mentioned above a few authors have considered the wave produced by such a disc 10 as shown in FIG. 1 as comprising a plane wave 11 together with an edge wave 12 with a spreading wave front. Recent work has shown that pulses propagating in a fluid from an ultrasonic transducer are as shown in FIG. 1 and in fact the wave fronts can be visualized using a stroboscopic Schlieren system.

Figure 3A:
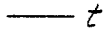
Figure 3B:
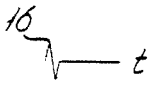
Figure 3C:
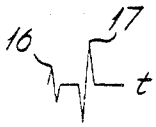

In fluids, the effect of the combination of plane and edge waves on an ultrasonic system where an object 13 to be imaged is in the near field is shown by the schematic Schlieren diagrams of FIGS. 2*a* to 2*d*. In FIG. 2*a* two reflected waves 14 and 15 due to the plane wave and edge waves, respectively, of a pulse emitted from the disc 10 are seen starting to travel towards the disc 10. The leading-edge of wave 14 is a displacement of the propagating medium in one longitudinal direction and is marked +, while the wave 15 is a displacement in the opposite direction and is marked −. FIGS. 3*a* to 3*c* show the output voltages plotted against time obtained from the disc 10 when used to receive reflected pulses. In FIG. 3*a* this output voltage is zero since no reflected pulse has yet reached the disc 10.

In FIG. 2*b* the wave front 14 due to the reflection of the plane wave 13 has just reached the disc 10 but the wave front 15 due to the edge waves is still on its way towards the disc. Thus in FIG. 3*b* a first output voltage pulse 16 is shown.

In FIG. 2*c* the wave front 15 due to the reflection of the edge waves has just reached the disc 10 but in addition wave front 14 has reached the edges of the disc so that a combined pulse of double amplitude 17 is seen in the output voltage as shown in FIG. 3*c*. These pulses are additive because the pulse generated when a spherical wave reaches the edge of a disc shaped transducer is of opposite polarity to the pulse generated when such a wave reaches the centre of the transducer.

Figure 3D:
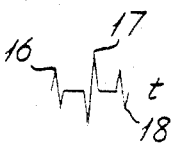

Finally, the wave front 14 reaches the edge of the disc 10 and produces a further pulse 18 shown in FIG. 3*d*.

Thus a single pulse emitted from the transducer 10 produces three output pulses 16, 17 and 18 of differing amplitudes when the axial object 13 to be imaged is in the near field. Clearly such a response blurs any imaging of the object 13 and where there are several objects near to one another the images generated overlap one another. The effect is not so pronounced outside the near field but an improvement is nevertheless obtained when the invention is adopted. Schlieren diagrams can also be used to show that where a pulse is received from a point source the centre of the transducing element produces a first pulse when the wave front from the source first reaches the transducer, and a further pulse of opposite polarity when the wave front reaches the edge of the transducer.

Having described the operation of the usual prior art pulsed ultrasonic system in the near field, the operation of an embodiment of the invention will now be described.

An edge wave transducder element 20 which does not transmit plane waves is used and the effect is seen in FIGS. 4*a* to 4*d* and 5*a* and 5*d*.

In FIG. 4*a* only a single wave front 21 is produced when the edge waves from the transducer 20 are incident on the object 13. Since there is no central portion of the transducer 20 there is no plane wave which is incident on the object 13 to produce a wave front corresponding to the wave front 14 of FIGS. 2*a* to 2*d*.

FIG. 4*b* corresponds in time delay after pulse transmission to FIG. 2*b* but no output pulse is produced in FIG. 5*b* since there is no wave front corresponding to the wave front 14 to impinge on the transducer 20. Additionally there is no central portion to this transducer which would respond to the wave front 14. Again no output voltage is produced in FIG. 5*c* when the wave front 21 reaches the centre of the annulus 20 since there is no transducer material at this central point. Hence the pulse 17 is absent from FIG. 5*c*.

The only output pulse is produced when the wave front 21 reaches the edge transducer 20 as shown in FIG. 4*d* and this pulse 22 which appears in FIG. 5*d* corresponds to the pulse 18.

Thus it can be seen how in this embodiment the present invention provides a single unambiguous pulse 22 due to reflection from an object 13 in the near field. This pulse is of half the amplitude of the pulse 17 but is nevertheless amply sufficient to provide good imaging. Schlieren diagrams can also be used to illustrate how a wave from a point pulse source incident on an annular receiving element generates a single pulse instead of the two pulses generated by a disc element. The response of an annular receiving element to a plane wave and an edge wave, such as would be received from a conventional disc transducer by way of a reflecting object, is two pulses. One pulse is generated when the reflection of the plane wave reaches the annular element and the other when the reflection of the edge waves arrives. Thus a system employing plane plus edge wave transmission but an annular receiving element is an improvement on the conventional system since two receive pulses instead of three are received for each transmitted pulse.

A property of edge waves used in the above definition which is not an attribute of other spreading waves (that is waves with enlarging wavefronts) is that for a circular source the peak pressure of the wave is constant along the source axis. In FIG. 6 two diametrically opposite points 80 and 81 of a circular edge wave source are shown with respective polar diagrams 82 and 83 including a number of pressure vectors. The directivity shown compensates for the spreading nature of the wavefront with the result that peak pressure on the source axis remains constant with range. This constant peak pressure gives improved range sensitivity over other types of wave for example a toroidal wave (which is a cylindrical spreading wave emitted from some forms of circular source) since toroidal waves have a peak pressure which falls off as $1/\sqrt{d}$ where d is the distance from the source. In focussed sources the on axis peak pressure is only constant over a relatively short distance and hence good sensitivity is confined to a small range.

Of course there are limits to the range resolution of edge wave sources because the theoretically ideal edge wave source cannot be obtained in practise and at large distances there is a gradual fall in on axis peak pressure.

It can also be shown that the lateral resolution of an annular edge wave only circular transducer is superior to a conventional disc-shaped circular transducer both in the near and far fields. This is because the lengths of propagation paths from one portion of the edge of a disc to another portion, or back to the said one portion, are the same for objects on the disc axis only. Hence reflected pulses are additive for such points but only partially or not at all for other points.

A practical ultrasonic transducer which can be used for transmission and/or reception of ultrasonic edge waves in the frequency range is shown in FIG. 7. A conventional transducer element in the form of a disc 25 of piezoelectric material (such as lead metaniobate PMN or lead zirconate titanate PZT) has front and back electrodes 26 and 27. A connection is made to the back electrode by means of a wire 28 and to the front electrode by means of a conductive case 29 which is filled with an extremely dense backing material 30 such as tungsten loaded epoxy resin. In this instance the loading must not be sufficient to make the material electrically conducting. By using this dense material to back the element, the transducer is capable of generating wide band pulses. An attenuating disc-shaped plate 31 having a smaller diameter than the disc 25 is fixed to the front electrode to suppress almost all plane waves. This attenuating plate consists of closed air cell plastic material, such as self adhesive plastic foam, 1 mm in thickness. Such a transducer is suitable for ultrasonic pulses having a spectrum extending from 1 to 5 MHz. In an alternative arrangement the attenuating plate is only about 10 $\mu$m thick and is constructed from epoxy or polythene resin incorporating a foaming agent to introduce air bubbles. The difference between the diameters of the attenuating plate 31 and the disc 25 should be at least one wavelength at the centre frequency of operation (that is the centre frequency of the pulse spectrum) and the radius of the disc 25 should preferably be greater than ten wavelengths at this frequency.

In order to give some idea of the improvement which can be obtained with the present invention FIG. 8 illustrates a C scan image obtained with the transducer of FIG. 7 employing a 16 mm disc when scanning a row of screws (two of each, 0 to 10 BA, or about 6 mm to 1.5 mm diameter) shown in FIG. 9, one of which is designated 31. (A "C" scan image is one in which the target is shown viewed in cross section as it would be seen by the eye if the eye could penetrate the intervening medium in which the ultrasonic waves propagate—see the book "Biomedical Ultrasonics", by P. N. T. Wells, published by Academic Press, 1977, pages 224 and 225). The screws projected vertically from a block of metal 32 and an ultrasonic "C" scan at a centre frequency of approximately 3 MHz was taken at a distance 30 mm vertically above the row of screws using the transducer of FIG. 7. The images of FIG. 8 were obtained where the image 33 corresponds to the screw 31.

FIG. 10 shows the corresponding "C" scan image obtained using a 16 mm conventional circular disc transducer and the same row of screws as a target, the frequency and target distance being the same.

FIG. 11 shows a first alternative method of construction for a transducer according to the invention. In FIG. 11 those items which are the same as in FIG. 7 have the same designations. The front electrode 35 of FIG. 11 is annular and its centre is filled with a disc of insulating material 36. The electrode 35 overlaps the edge of the disc 25 and only in this overlapping region is the piezoelectric material of the disc 25 active in generating or receiving ultrasonic or sonar vibrations.

As a result nearly all plane waves are suppressed because the disc 25 is non-linearly excited, the lower electrode extending only partially across the element and causing fringing electric fields to occur in the element.

An example of lateral resolution and change of lateral resolution with range for an embodiment of the invention (similar to that shown in FIG. 11 but with the electrode 35 extending across the whole outside of the layer 36) will now be given with reference to FIGS. 14*a* and 14*b*. This edge wave only transducer has the beam profiles shown in FIG. 14*a* over a range of 10 mm to 150 mm in 10 mm steps, the 10 mm profile being shown at the "front" of the figure. The scale shown is in millimeters off axis.

FIG. 14*b* shows similar profiles for a conventional focussed transducer with focus at 30 mm and ranges from 20 mm to 45 mm with 5 mm intervals. The greatly improved constancy of lateral resolution and sensitivity of the edge wave only transducer can be appreciated.

When such a transducer was used to form a B scan image of three vertically spaced grids of nylon threads (each spaced by 40 mm), each thread having diameter 0.5 mm with the closest thread spacing at 2.0 mm, the threads in all three levels were resolved, demonstrating the improved depth of focus of this transducer.

Embodiments of transducers which employ Gaussian piezoelectric polarization are shown in FIGS. 12*a* and 12*b*, and the form of the distribution used is shown in FIG. 12*c*.

Such polarization may be achieved by first removing all polarization in a disc of amorphous piezoelectric material by heating the material to a temperature which is above the Curie point and at the same time either ensuring that there is no electric field applied to the material or that any field so applied is rapidly alternating. Having depolarized the material in this way a uniform axial electric field is applied to a fairly wide annular area the disc and the temperature is raised sufficiently to alloy about 5–10% of domains in the material to take up an axial polarization. Several more steps of this type are carried out with the electric field being applied to a gradually narrower annular area having a gradually increased inner radius. The process for polarizing annular material is described in U.S. Pat. No. 2,928,163 and the paper "Polarising Techniques for Ferroelectric Ceramics" by R. M. Gruver et al Linden Labs. Inc., May 1966, report No. AD801027.

In FIG. 12*a* a piezoelectric disc 60 of radius r is polarized in the way shown in FIG. 12*c* with the half amplitude width of the Gaussian curve equal to 2λ and λ is the wavelength, in the propagating medium, at the centre frequency of the pulse spectrum. Since each limb of FIG. 12*c* extends over half a Gaussian curve only, the half amplitude width is shown as λ not 2λ and since it is the outer edge of the disc 60 which is considered as the source of edge waves the peak of the Gaussian curve is at this edge.

The disc 60 is positioned between a front electrode 61 and a rear electrode 62. The transducer is contained by a cylindrical metal case 64 which allows electrical contact to be made to the electrode 61, contact to the other electrode being made by means of a wire 65 buried in acoustic damping material 30 which may be tungsten backed epoxy resin. Since improved bandwidth can be obtained with a loaded resin which is electrically conducting (because of its high tungsten to epoxy ratio) it is now necessary to incorporate an insulating layer 63. The layer 63 of electrically insulating acoustic damping material such as epoxy resin loaded with red lead oxide therefore insulates the electrode 62 and the material 30 from the case 64.

The transducer of FIG. 12*b* is similar to that of FIG. 12*a* except that the front electrode 61′ is thicker and has a recess for insulating material 67. Thus in the electrode of FIG. 12*b* edge waves are removed not only by the non-linear polarization of the disc 60 but also by the screening effect of the layer 67 when this is of a material which has a similar effect to the plate 31 in FIG. 7. In addition since the electrode 61′ is only in contact round the periphery of the disc 60 the disc is non-linearly polarized so enhancing the suppression of edge waves. The arrangement of FIG. 12*b* also allows the electrode 61′ to be used as a r.f. screen across the whole disc 60, even though it is only in contact at the edges. The radial width of the thicker part of the electrode 61′ is chosen to be between 1 and 5λ depending on the actual polarization obtained in the disc 60.

In FIG. 13*a* a piezoelectric ring 70 is polarized in the way shown in FIG. 13*b* and since peak polarization is at the inner periphery of the ring 70, it is this periphery which acts as the edge wave source. The techniques used for polarization are similar to those described in connection with FIG. 12*c* except that in this case after the ring has been depolarized the stages of polarization are carried out with the outer radius of the applied electric field descreasing each time a further stage of polarisation is carried out. The radial width of the ring 70 is made at least 10λ to avoid problems with unwanted radial modes of vibration. A disc-shaped metal front electrode 71 makes contact with the inner periphery of the ring 70 providing non-linear polarization of the ring and the diameter of the electrode 71 can be chosen to provide optimum edge wave suppression in conjunction with the actual polarization obtained in the ring 70. The electrode 71 is connected by way of a further electrode 72 and a wire 73 buried in the acoustic damping material 63. A metal rear electrode 75 in the form of a ring makes contact with the back of the piezoelectric material 70 and is connected by a wire 76 buried in the material 30. That part of the ring 70 which is not covered by the front electrode 71 is protected by a ring of insulating material 77 and the transducer is contained in a metal case 78. A layer 79 of electrically-insulating acoustic damping material insulates the electrode 75 and the material 30 from the case 78.

For wide-band transducer operation, electrode thicknesses should be a small fraction of the wavelenths propagated, and in FIG. 12*b* the combined thickness of the electrode 61' and the layer 67 should still meet this requirement.

Where annular transducer elements are used without at least approximate Gaussian polarization or excitation, the internal radius should usually be at least five wavelengths at the frequency to be used (for example the centre frequency of a pulse) and the outer radius should not be more than five wavelengths greater than the inner radius.

While the transducer specifically described according to the invention have annular active surfaces, it will be appreciated that other shapes may be used in special circumstances. For example the active surfaces can be in any ring form, such as elliptical, and active surfaces having this shape may be useful in imaging elliptical objects or in determining the orientation of elongated targets. The transducer may comprise a number of point transducers arranged, for example in a circle, instead of a single ring-shaped element or a disc with a damped central portion.

Where an edge wave only line source is required, the active surfaces of the source may follow two parallel lines.

A single transducer may incorporate separate elements for transmission and reception, respectively, either or both of which may transmit, or respond to, edge waves but not plane waves. For example a conventional piezoelectric disc element may be positioned immediately in front of the central portion of the electrode 71 of FIG. 13*a* and used for transmission or reception when the annulus 70 is used for reception or transmission, respectively.

Although the specific description of the operation of the invention has been limited to pulse systems there is nothing specific to such systems in the operation of the present invention and therefore it can equally be applied to continuous wave (CW) systems. For example in CW ultrasonic tissue destruction, where only transmit transducers are required, the improved focussing along the transducer axis due to the invention is advantageous. The invention is also useful in other ultrasonic CW applications such as Doppler velocimetry, range-finding and imaging.

The invention has application from audio frequencies as low as, or below, 1 KHz up to 1000 MHz for use in ultrasonic microscopes, for instance. Thus the medical diagnosis range of about 1 to 5 MHz and the non-destructive testing range 1 to 20 MHz are included.

Other types of transducer elements than piezoelectric may be used for example magnetorestrictive elements are suitable.

Whereas the above specific description of this invention has been in relation to propagation in fluids, the invention is also applicable to propagation in solids.

Since the other elements, components and circuits of ultrasonic and sonar systems are well known they are not described here, but a textbook which gives further details is that mentioned above; that is "Biomedical Ultrasonics", by P. N. T. Wells, published by Academic Press, 1977. Further details are also obtainable from "Instrumentation Associated with the Development of Wide Band Ultrasonic Techniques (Ultrasonic Spectroscopy)" by J. P. Weight, M Phil, Thesis, The City University, London, 1975.

I claim:

1. A method of transmitting waves propagated by vibration of a propagating medium comprising the step of:

transmitting by an ultrasonic generation element edge wave substantially without plane waves so that a constant peak pressure is produced along the axis of transmission from the generation element into the far field.

2. A method of deriving signals from received waves propagated by the vibration of a propagating medium comprising the steps of:

receiving ultrasonic waves by an ultrasonic receiving element;

deriving from said received waves signals which are representative of edge waves received; and substantially eliminating the generation of signals representative of plane waves wherein said receiving element, if used for transmission, would produce a constant peak pressure along the axis of transmission into the far field.

3. A method according to claim 1 or 2 wherein the edge waves are propagated as a circular ring of waves.

4. A transducer for conversion between electrical signals and waves propagated by the vibration of the propagating medium, comprising:

means for converting between edge waves and electrical signals, and for inhibiting conversion between plane waves and said signals, said means producing a constant peak pressure along the axis of transmission from the transducer into the far field if used for conversion from an electrical signal to said waves.

5. A transducer according to claim 4 wherein, in operation, the edge waves are propagated as a circular ring of waves.

6. A transducer according to claim 5 comprising an element of piezoelectric or magnetorestrictive material which has at least one of the following properties:

the element responds, in operation, to a spatially varying electric field between electrodes in contact with the element, the element has a spatially varying polarization, and the element has a surface relief such that edge waves, but substantially not plane waves, are transduced.

7. A transducer according to claim 6 wherein the element is a disc which is, in operation, excited by (or generates) a spatially varying electric field between first and second electrodes, the first electrode contacts substantially the whole of one major surface of the disc, and the second electrode contacts only an annular area of the other major surface of the disc adjacent to the periphery of the disc.

8. A transducer according to claim 6 wherein the element is a disc which has a spatially varying polarization of substantially Gaussian form with peak polarization at the disc periphery and comparatively low polarization at the centre of the disc, the disc having first and second electrodes which are respectively in contact with substantially the whole of the major surfaces of the disc.

9. A transducer according to claim 6 wherein the element is a disc which has a spatially varying polarization of substantially Gaussian form with peak polarization at the disc periphery, and the disc is, in operation, excited by, or generates, a spatially varying electric field, by virtue of a first electrode in contact with substantially the whole of one major surface of the disc and an annular second electrode in contact only with an annular area of the other major surface of the disc adjacent to the periphery of the disc.

10. A transducer according to claim 6 and wherein the element is an annulus which has a spatially varying polarization of substantially Gaussian form with peak polarization at one periphery of the annulus and comparatively low polarization at the outer periphery thereof.

11. A transducer according to claim 10 wherein the annulus is, in operation, excited by, or generates, a spatially varying electric field by virtue of a first electrode in contact with substantially the whole of one annular surface of the annulus, and a second electrode in contact only with an annular portion of the other annular surface of the annulus adjacent to the inner annulus periphery.

12. A transducer according to claim 6 arranged for use as a receiver for converting said waves to electrical signals.

* * * * *